US008579672B2

(12) United States Patent
Beutler

(10) Patent No.: US 8,579,672 B2
(45) Date of Patent: Nov. 12, 2013

(54) LIGHTING FOR WHEELS

(75) Inventor: Jörg Beutler, Holzkirchen (DE)

(73) Assignee: Maurer Soehne GmbH & Co. KG, Munich (DE)

( * ) Notice: Subject to any disclaimer, the term of this patent is extended or adjusted under 35 U.S.C. 154(b) by 214 days.

(21) Appl. No.: 13/008,887

(22) Filed: Jan. 18, 2011

(65) Prior Publication Data

US 2011/0177870 A1 Jul. 21, 2011

(30) Foreign Application Priority Data

Jan. 19, 2010 (DE) ..... 10 2010 000 132

(51) Int. Cl.
*A63H 33/22* (2006.01)
*A63H 33/00* (2006.01)

(52) U.S. Cl.
USPC ..... 446/219; 446/438; 472/61; 362/161

(58) Field of Classification Search
USPC ..... 446/129, 137, 138, 175, 219, 438, 439; 362/78, 192, 276, 500, 800; 472/43, 61
See application file for complete search history.

(56) References Cited

U.S. PATENT DOCUMENTS

| | | | | |
|---|---|---|---|---|
| 3,789,209 | A | 1/1974 | Weber et al. | |
| 4,298,910 | A | 11/1981 | Price | |
| 4,782,431 | A * | 11/1988 | Park | 362/161 |
| 4,991,066 | A | 2/1991 | McCowan | |
| 5,067,058 | A | 11/1991 | Standley | |
| 5,132,883 | A | 7/1992 | La Lumandier | |
| 5,390,941 | A | 2/1995 | Pozzobon et al. | |
| 5,456,478 | A | 10/1995 | Hsu et al. | |
| 5,475,572 | A | 12/1995 | Tseng | |
| 5,810,450 | A | 9/1998 | Tsu et al. | |
| 6,398,395 | B1 | 6/2002 | Hyun | |
| 7,048,421 | B1 * | 5/2006 | Allen-Atkins | 362/500 |
| 2002/0024816 | A1 | 2/2002 | Ming-Li | |

FOREIGN PATENT DOCUMENTS

| | | | |
|---|---|---|---|
| DE | 29502133 | U1 | 5/1995 |
| DE | 29606965 | U1 | 8/1996 |
| DE | 29604321 | U1 | 9/1996 |
| DE | 29615919 | U1 | 8/1997 |
| DE | 20016965 | U1 | 3/2001 |
| DE | 202009009084 | U1 | 10/2009 |

(Continued)

OTHER PUBLICATIONS

European Patent Office search report issued May 11, 2001 for the instant U.S. application's counterpart application in EPO (EP 11150162.3).

*Primary Examiner* — Kien Nguyen
(74) *Attorney, Agent, or Firm* — Edwards Wildman Palmer LLP; David L. Greenbaum; David A. Tucker

(57) ABSTRACT

A car 1 for amusement devices comprises a frame (not shown), which is connected to a person-receiving apparatus 10. A running gear 30 is arranged on the frame. Arranged on the running gear 30 and spaced at a distance from the frame and from the person-receiving apparatus 10 are rotatable wheels with coils and illumination elements 33 integrated therein. Between the wheels 31 and the running gear 30 is arranged in each case at least one magnet 32, such that electric current is induced in the coil by rotation of the wheels 31 for feeding the illumination elements 33.

16 Claims, 4 Drawing Sheets

(56) References Cited

FOREIGN PATENT DOCUMENTS

| | | | |
|---|---|---|---|
| EP | 0793984 | B1 | 11/2003 |
| EP | 1683558 | A1 | 7/2006 |
| GB | 2294753 | A | 5/1996 |
| GB | 2370923 | A | 7/2002 |
| WO | 0207829 | A1 | 1/2002 |
| WO | 2008114437 | A1 | 9/2008 |
| WO | 2009038391 | A1 | 3/2009 |

* cited by examiner

LIGHTING FOR WHEELS

FIELD OF THE INVENTION

The invention relates to a car for amusement devices, which primarily comprises a frame and a person-receiving apparatus.

PRIOR ART

The prior art discloses various ways for showmen of amusement rides to draw attention to themselves. Usually, for example, loud music is employed. The acoustic effect can additionally be supported by various announcements, with additional swozzles and noise generators being used.

Especially, in the evening or at night, optical means are used in addition to the acoustic means, such as garish illumination of the installation by different-coloured lamps and strings of lights, which also can have flashing effects. The illumination means are mounted inter alia to the chassis or to the cars of the rides.

With regard to the above options, it should be noted that changing displays attract more attention than the monotonous kind, with the result that frequently changing light colours or flashing lights are employed. Another option is afforded by chaser lights and also light controllers, which selectively actuate certain lamp clusters.

TECHNICAL OBJECT

It is therefore an object of the invention to provide an illumination device for an amusement device, which said illumination device is mobile, with which different optical effects can be achieved, and which is particularly rugged in order that it may be used without problems in roller coaster cars.

TECHNICAL SOLUTION

This object is achieved by a car for amusement devices in accordance with claim 1 and a wheel in accordance with claim 15. Advantageous embodiments are the subject of the dependent claims.

The inventive car with a frame and a person-receiving apparatus comprises an illumination device with at least one light source, with the illumination device being arranged on at least one wheel. Especially, the light source is arranged on the wheel. Through the wiring and operation of the light sources, the movement particularly of the car in different directions, namely in a forwards, top, bottom and backwards direction, or combinations thereof, is used to achieve varying or changing and moved optical effects. Thus, the moving mobile light source attracts attention to the amusement device, especially to the car, with additional illumination of the car being possible. The light sources move linearly in the direction of travel on one hand and, on the other, they rotate (the movement is superimposed on the linear movement) in a circular path about the axis of rotation of the wheel.

In one embodiment of the invention, the light source can be an LED. LEDs are characterised particularly by low energy consumption, the possibility of several light colours and short on/off times and can be controlled in a simple manner. Depending on the desired display, the "pixel density" (each LED can represent a pixel) can be varied, and different-sized and different-shaped or different-coloured LEDs can be used. Thus, it is entirely possible for a corresponding control circuit or corresponding actuation to generate different effects on the wheels of the cars. For example, it is possible for one or more LEDs to form independent switch groups, which are actuated separately. In addition, sensors such as speed sensors, brightness sensors, acoustic sensors, accelerometers or position sensors can be used to achieve defined actuation of the illumination elements. The position sensors, for example, can determine the instantaneous angle of rotation of the wheel relative to the chassis and/or relative to a particular plane, such as the Earth's surface, and/or the position of the car relative to a certain plane, such as the Earth's surface.

However, light panels may also be used in addition or as an alternative to the LEDs. These can be arranged on the full visible surface of the wheels.

To electrically power the illumination elements and/or the circuitry, a power-generating unit with an inductor (e.g. coil) can be arranged on the car. The movement of the car can generate electrical power in the inductor. In this regard, in one embodiment, the at least one inductor can be arranged on the wheel and corresponding thereto at least one magnet (e.g. permanent magnet) can be arranged on the running gear, frame or on the rail (stationary). The magnet is especially arranged so as to be stationary on the running gear, such that current is induced in the inductor by the rotation of the wheel. The electrical energy can thus be supplied internally into the wheels, thereby simplifying the supply of electricity. Tapping of electrical energy, for example by a collector device or by transport of electricity into the wheel is unnecessary. There is no need for a connection to the chassis (e.g. in the form of a sliding contact).

Basically, any generator principle can be used which converts the car's kinetic energy into electrical energy. Especially, that kinetic energy which arises from the rotation of the wheel with respect to the frame or the person-receiving apparatus can be used. The movement of the wheel can be used to induce current.

In a generator is provided a rotor (fitted with electromagnet or permanent magnet), which is rotated relative to a stationary stator housing. The circumferential magnetic field produced by the rotor with the permanent magnet or electromagnet causes electrical voltage to be induced in the inductor provided on the stator (e.g. conduction coils). The wheel can be schematically considered as a rotor. The present invention, however, primarily utilises the principle of a generator in which the current is induced in the rotor (wheel). The field coil or the permanent magnet is mounted to the frame or the person-receiving apparatus so as to be stationary. The power generated is immediately available in the wheel.

Where electromagnets are used, the induced voltage can be controlled by the size of the excitation field. Consequently, the magnetic field and thus the voltage induced in the induction coil can be controlled. For example, the magnetic field of the field coil(s) can be controlled as a function of the rotational speed of the wheel such that, at least after a minimum speed has been exceeded, a more or less constant voltage or current or power is induced.

Since the rotational speeds of the rotational movement of the wheel vary, the induced voltages are also different. In order that the light source may be actuated in the context of a nominal voltage, it is possible (independently of or in addition to provision of field coil control) for switching elements to be provided for the purpose of voltage limitation or voltage reduction or voltage-raising components (e.g. transformers). Intermediate storage of electrical energy and a release of energy from the intermediate storage, at a suitable power and voltage, would also be conceivable.

Through the use of induced electricity generation, at least a portion of the supplied electrical energy can be used by the control circuit to actuate the illumination elements, such that the colour of the light changes with a change in movement speed or rotational speed of the wheels.

With the above-mentioned inventive configuration of a car for an amusement device, especially a roller coaster or a ride, mobile illumination becomes possible, with the wheels of the moving car serving as illumination carriers.

Different lighting effects can be created by supplying different circuits via the power source that actuate the light sources in different ways (e.g., one circuit produces sufficient power at low speeds to light the coloured LEDs while, at higher speeds only, a second circuit actuates differently coloured LEDs).

The controller (e.g. microcontroller) or circuit for actuating the LEDs and any additional sensors (to measure the rotational speed of a wheel or the position of the car) can generate special lighting effects, especially standing patterns etc. Thus it is possible to vary the number of illuminated LEDs, the colour of the respective LEDs, the selection of illuminated and non-illuminated LEDs as a function of the sensor reading. The controller (e.g. microcontroller) or circuit for actuating the LEDs can be arranged on the wheel.

The illumination device preferably has a (circuit) board to which the light source is mounted.

Especially, the power source is mounted to the board. In the case of an inductive power source, the inductor/coil is arranged on the board.

The illumination device can have a board for mounting the power source to the board. In the case of an inductive power source, the inductor/coil is arranged on the board.

The board is preferably attached to a wheel rim of the wheel. For example, the board can be encapsulated in the wheel rim (with polymer or the like) in order that corrosion or other damage may be avoided. The encapsulation also takes on the role of damping for the shock-sensitive components. In addition, it is necessary to immobilise all parts (e.g. by encapsulation) so that they do not detach from the wheel and so that accidents and other damage by detached parts are avoided.

The car is a rail car for amusement purposes, especially a roller coaster car. Due to the high loads generated on the cars in this application the illumination device must be of a rugged design. The illumination device must also work perfectly when exposed to high speeds, to heavy shocks (which are transmitted directly because the wheel coatings employed have little damping capacity), moisture, dirt, etc. Furthermore, the invention ensures that personal safety is guaranteed, i.e. in particular, parts cannot become detached from the board or the board itself from the wheel. The mounting between the wheel and the board is especially of the positive and/or material-fit type.

An inventive wheel for an amusement car, especially for a roller coaster car comprises at least one light source and an inductive power supply.

The wheel can comprise at least one inductor attached thereto.

The wheel comprises especially at least one inductor attached thereto for the purpose of interaction with at least one stationary magnet arranged on the car.

Especially, at least one light source is mounted to the wheel.

BRIEF DESCRIPTION OF THE DRAWINGS

Further advantages, characteristics and features of the invention are apparent from the following detailed description of embodiments using the enclosed drawings. The drawings show in.

DETAILED DESCRIPTION OF THE DRAWINGS

Figure 1:
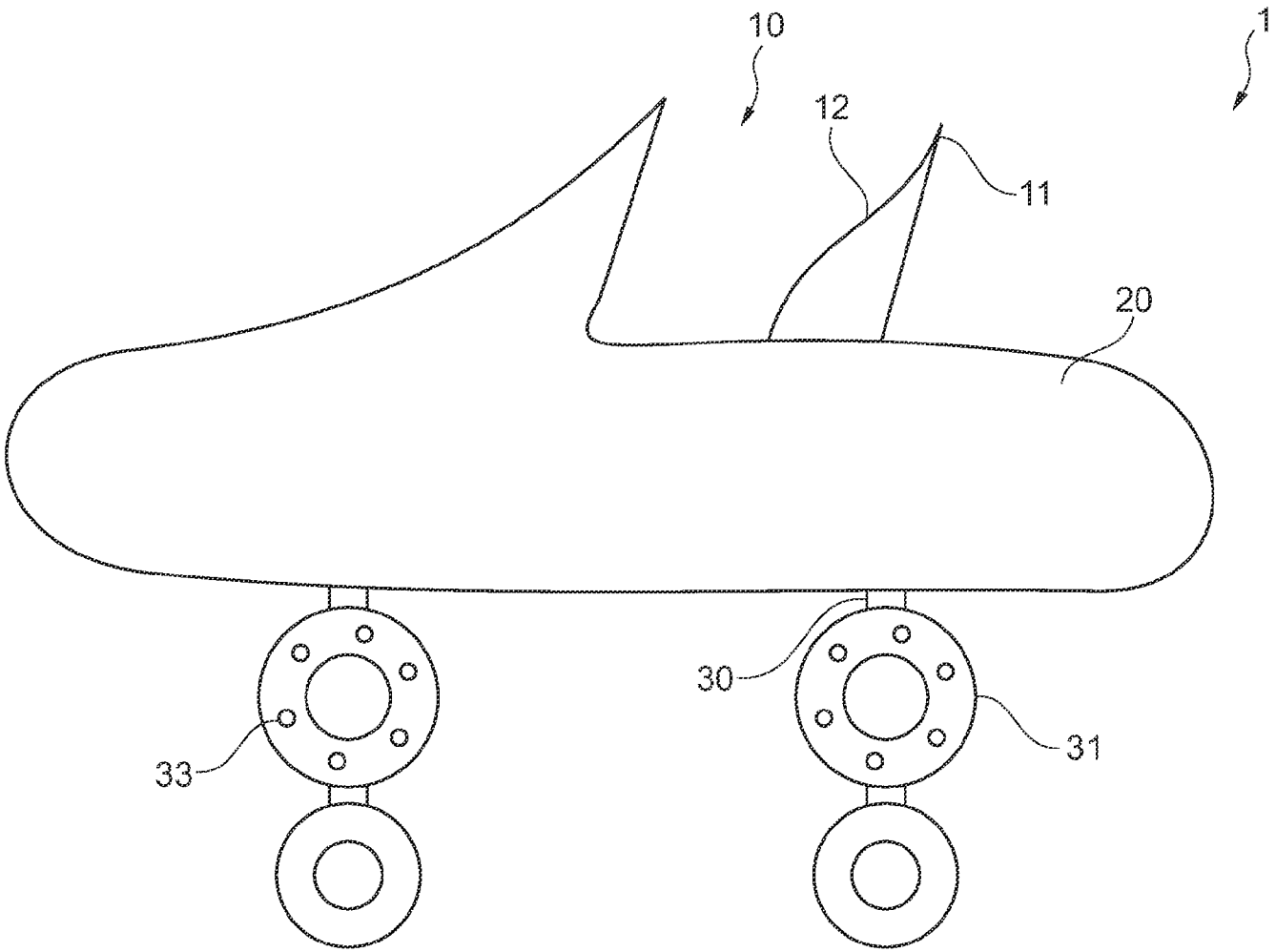
FIG. 1 a side view of a car for amusement devices in accordance with one embodiment of the invention.
Figure 2:
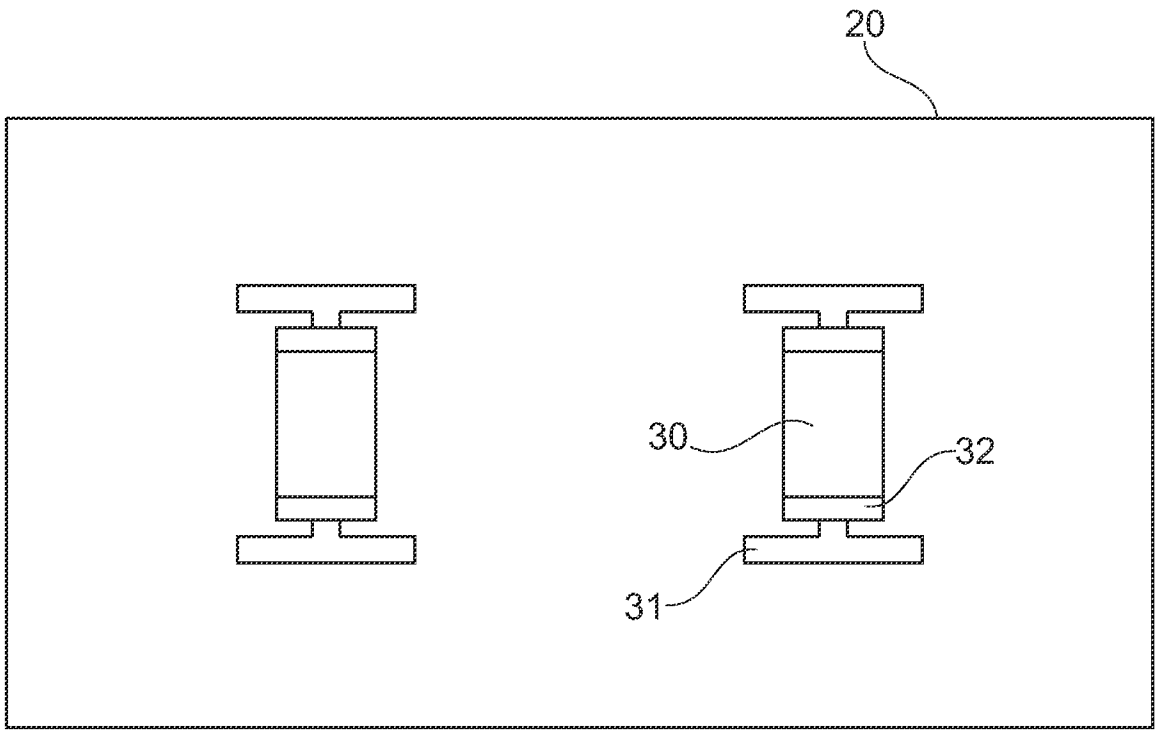
FIG. 2 a bottom view of the car for amusement devices in accordance with FIG. 1.

FIGS. 1 and 2 schematically show an embodiment of the invention. A car 1 for amusement devices, especially for roller coasters or rides, comprises a frame (not shown), which is connected to a person-receiving apparatus 10. Relative to the frame, the person-receiving apparatus 10 is pointing upwards. The person-receiving apparatus 10 can comprise, for example, a seat or seat shell and additionally has a backrest 11 and side-stabilising elements 12 for ensuring that a passenger has a secure hold despite any acceleration torque. The person-receiving apparatus 10 and the frame are surrounded at least partially by a housing 20. The housing 20 can for example be configured as a car, a rocket or an aircraft.

Furthermore, a downward-pointing running gear 30 is arranged on the frame. Arranged on the running gear 30 and spaced at a distance from the frame and from the person-receiving apparatus 10 are rotatable wheels 31. As is common with many rides, the wheels 31 are provided in a double, stacked arrangement. A rail can run between the wheels 31 such that the car can be guided stably and safely on the rail. Between the wheels 31 and the running gear 30 is arranged in each case at least one permanent magnet 32. In the corresponding wheels 31, at least one coil is arranged or integrated. Thus, rotation of the wheels 31 and the changing magnetic field (north-south pole of the permanent magnet 32) can induce electric current in the coil or in the wheels.

The induced current is transported to a circuit integrated in the wheel 31. The circuit comprises a control circuit for actuating and regulating the illumination elements 33. In this regard, the control circuit can be equipped with a microcontroller and various sensors such that, for example, various illumination elements 33 can be operated at different, measured speeds.

Figure 3:
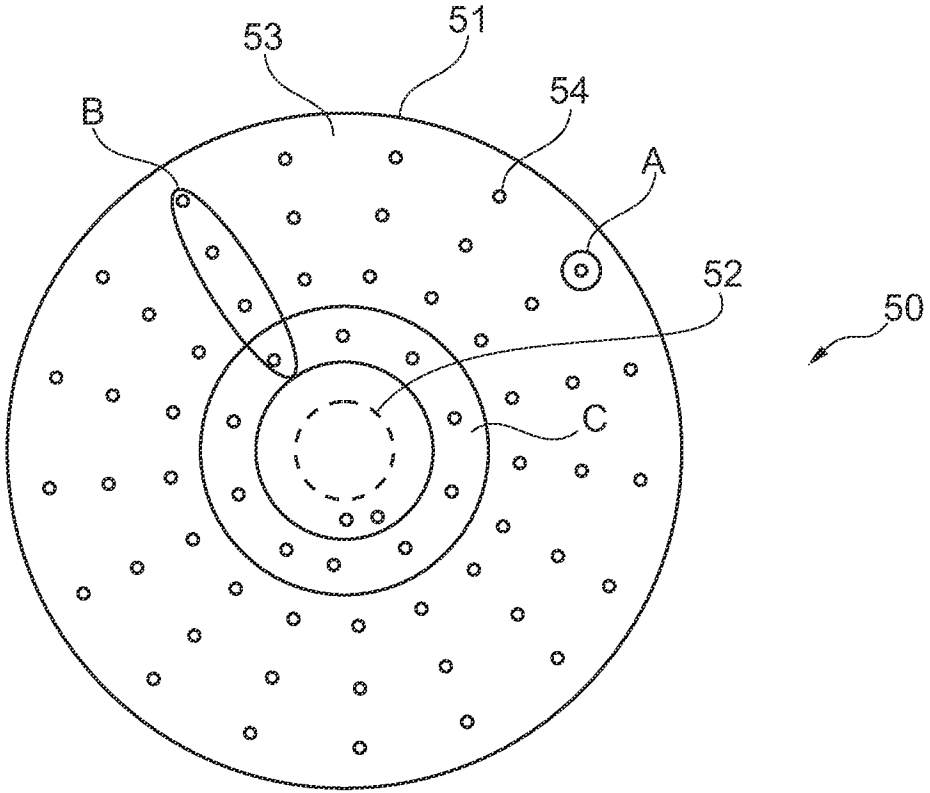
FIG. 3 a schematic illustration of a wheel of a car for amusement devices in accordance with the invention.

Integrated into the rotating wheels 31 are coils and illumination elements 33. Between the wheels 31 and the running gear 30 is arranged at least one magnet (permanent magnet or electromagnet) 32, such that electric current is induced in the coil by rotation of the wheels 31, said current feeding the illumination elements 33. FIG. 3 shows a side view of a wheel 50 in accordance with one embodiment of the invention, parallel to the running surface 51. The wheel 50 has an axle 52 (dashed lines) via which the wheel 50 is rotatably connected to the car.

As can also be seen from FIG. 3, several illumination elements 54 are arranged on the side face 53 of the wheel 50. In this embodiment, the illumination elements 54 are configured as LEDs. For shading, an LED can form a separate illumination cluster A. However, it is also possible for one or more radially aligned illumination clusters B and/or one or more illumination clusters C to be arranged in a ring.

Alternatively, the LEDs can be actuated separately, such that, for example, various patterns are produced as a function of the speed or the current orientation of the car.

The above-mentioned LEDs can also be replaced and/or supplemented by other illumination means or optical display means, such as illumination panels.

The arrangement of coils, LEDs and associated circuit (possibly with controller) can be mounted to a board (e.g., polymer board), which is then connected to the wheel so as to rotate with the latter. The board can be ring-shaped, for example. It can have slots for the LEDs and inwardly or outwardly protruding anchor-like projections for winding the coils on the projections. Thus, the arrangement is compact and key components are integrated on the board. The board can be provided, mounted to the wheel, replaced or removed for maintenance without the need for separating electrical connections to the chassis.

Alternatively, the LEDs can be electrically connected to the board by cable instead of directly. In another embodiment, the coils can, however, be bonded or soldered to the board. The coils can be bonded to the surface of the board such that, where mounted to the wheel, they can be accommodated in wheel cavities. The board can be bolted to the wheel, for instance.

By way of counterpart, a magnetic retainer plate can be provided on which are arranged permanent magnets or electromagnets which interact with the induction coils to generate electricity when the wheel rotates. The magnetic retainer plate can be made of plastic. It is mounted to the holding frame of the car such that it is stationary with respect to the rotational movements of the wheel.

Figure 4:
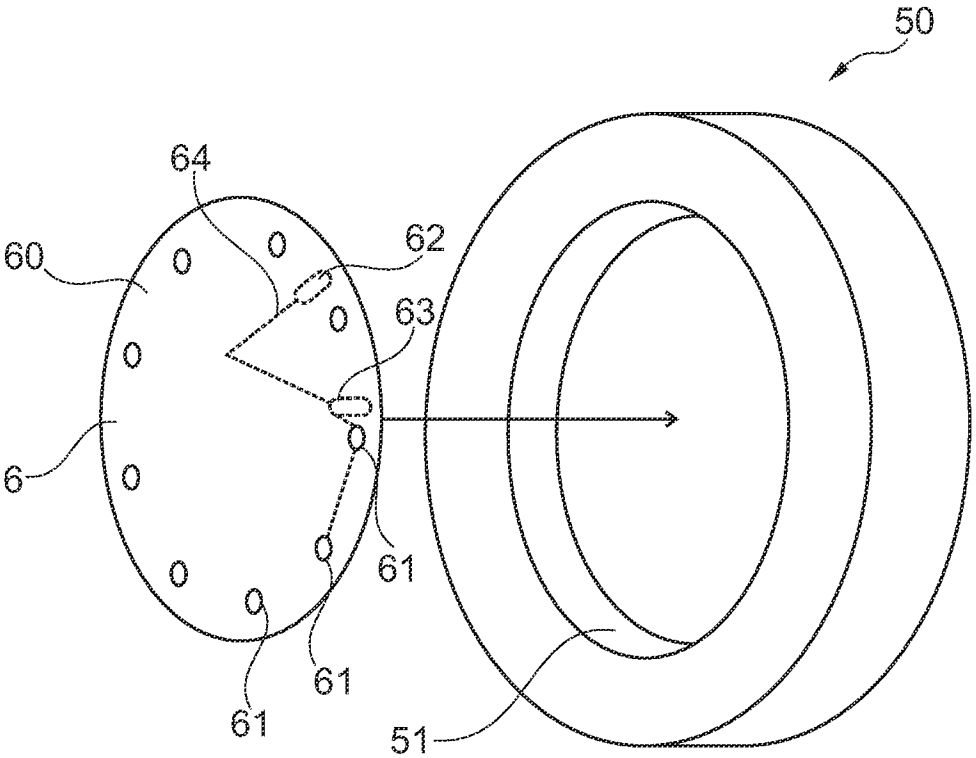
FIG. 4 components of an inventive wheel.

FIG. 4 shows an embodiment in which an illumination device is mounted to a board 6, which is encapsulated in the rim 51 of a wheel 50.

The board 6 has a base 60 and an illumination device. The base 60 consists of polymer and is encapsulated for example in plastic. In FIG. 4, the board 6 is shown separately from the wheel 50. The mounting is indicated by an arrow.

The components of the illumination device are a plurality of LEDs 61 which are arranged on the front of the base 60. On the rear of the device 60 are arranged coils 62, which rotate with the wheel 50. They interact with magnets (not illustrated) mounted to the frame such that rotation of the wheel 50 induces electric current in the coils 62. The illumination device also has a controller 63. This controls the power supply to the LEDs 61 via lines 64. The components 61, 62, 63, 64 of the illumination device form a circuit.

Although the present invention has been described in detail with reference to the embodiments, the invention is not limited thereto, but rather modifications through other types of combinations of features or omission of individual features are possible, without departing from the scope of the appended claims. The invention comprises all combinations of all the presented features.

The invention claimed is:

1. A car for amusement devices comprising:

a frame;

a person-receiving device; and at least one wheel provided on the frame, wherein the wheel comprises a printed circuit board including a base body and an illumination device having at least one light source;

wherein the printed circuit board is arranged detachably on the at least one wheel; and wherein the base body of the printed circuit board is encapsulated with plastic material.

2. The car in accordance with claim 1, wherein the at least one light source is an LED and/or a light panel.

3. The car in accordance with claim 1, wherein the car has at least one power source.

4. The car in accordance with claim 1, wherein the wheel has at least one power source.

5. The car in accordance with claim 4, wherein the at least one power source comprises a coil, such that electric current is induced in the coil when the wheel rotates.

6. The car in accordance with claim 5, wherein the coil is arranged on the wheel and, complementarily to the coil, a magnetic element, especially a permanent magnet or an electromagnet is connected to the frame.

7. The car in accordance with claim 5, wherein the coil is arranged on the wheel and, complementarily to the coil, a second coil is permanently connected to the frame.

8. The car in accordance with claim 5, wherein the coil is integrated into the wheel.

9. The car in accordance with claim 1, wherein a power source is mounted to the printed circuit board.

10. The car in accordance with claim 1, wherein the illumination device includes a circuit board to which a power source is attached.

11. The car in accordance with claim 1, wherein the printed circuit board is mounted to a wheel rim of the wheel.

12. The car in accordance with claim 1, wherein the car is a rail car for amusement purposes.

13. The car in accordance with claim 1, wherein the car is a roller coaster car.

14. A wheel for an amusement car comprising:

a printed circuit board including a base body and an illumination device having at least one light source;

wherein the printed circuit board is arranged detachably on the at least one wheel; and wherein the base body of the printed circuit board is encapsulated with plastic material; and further comprising an inductive power supply.

15. The wheel in accordance with claim 14, wherein the wheel comprises at least one inductor mounted thereto.

16. The wheel in accordance with claim 14, wherein the wheel comprises an inductor mounted thereto for interaction with at least one magnet arrange permanently on the car.

* * * * *